US009531116B2

(12) United States Patent
Brenner

(10) Patent No.: US 9,531,116 B2
(45) Date of Patent: Dec. 27, 2016

(54) ELECTRICAL DEVICE HAVING AN EXPLOSION-PROOF PLUG-IN CONNECTION

(71) Applicant: R. STAHL SCHALTGERÄTE GMBH, Waldenburg (DE)

(72) Inventor: Carsten Brenner, Niedernhall (DE)

(73) Assignee: R. STAHL SCHALTGERÄTE GMBH, Waldenburg (DE)

( * ) Notice: Subject to any disclaimer, the term of this patent is extended or adjusted under 35 U.S.C. 154(b) by 0 days.

(21) Appl. No.: 14/418,717

(22) PCT Filed: Jul. 11, 2013

(86) PCT No.: PCT/EP2013/064728
§ 371 (c)(1),
(2) Date: Jan. 30, 2015

(87) PCT Pub. No.: WO2014/019832
PCT Pub. Date: Feb. 6, 2014

(65) Prior Publication Data

US 2015/0180162 A1 Jun. 25, 2015

(30) Foreign Application Priority Data

Aug. 2, 2012 (DE) ..... 10 2012 107 091

(51) Int. Cl.
*H01R 13/53* (2006.01)
*H01R 13/703* (2006.01)

(52) U.S. Cl.
CPC ..... *H01R 13/53* (2013.01); *H01R 13/7036* (2013.01)

(58) Field of Classification Search
CPC ..... G01D 11/24; H01R 13/53
(Continued)

(56) References Cited

U.S. PATENT DOCUMENTS 2,943,213 A 6/1960 Green
4,166,664 A 9/1979 Herrmann
(Continued)

FOREIGN PATENT DOCUMENTS

DE 3446396 A1 6/1985
DE 19838492 A1 * 3/2000 ..... H01R 13/527
(Continued)

OTHER PUBLICATIONS

International Search report of corresponding PCT application No. PCT/EP2013/064728, dated Sep. 10, 2013, 6 pages.
(Continued)

*Primary Examiner* — Abdullah Riyami
*Assistant Examiner* — Nader Alhawamdeh
(74) *Attorney, Agent, or Firm* — Fitch, Even, Tabin & Flannery LLP

(57) ABSTRACT

An electrical device has a plug-in connection device (15), which is used to open and close an electrical circuit (24). The plug-in connection device (15) contains at least two contact/mating-contact pairs (22, 23), which have different ignition protection types. At least one of the two contact/mating-contact pairs is designed to interrupt the current running through said contact/mating-contact pair without triggering an explosion. (Ignition protection type Ex d or Ex i.) The other contact/mating-contact pair (23) opens and closes in the currentless state. Therefore, the other contact/mating-contact pair can have a second ignition protection type, such as Ex e.

14 Claims, 6 Drawing Sheets

(58) Field of Classification Search
USPC ..... 439/186
See application file for complete search history.

(56) References Cited

U.S. PATENT DOCUMENTS

| | | | | |
|---|---|---|---|---|
| 4,628,392 | A | 12/1986 | Didier | |
| 4,828,508 | A * | 5/1989 | Wettengel et al. | H01R 33/9658 439/136 |
| 4,927,382 | A | 5/1990 | Huber | |
| 7,794,252 | B2 | 9/2010 | Sauer et al. | |
| 2012/0198931 | A1* | 8/2012 | Schulze et al. | G01F 15/14 73/431 |
| 2013/0250460 | A1* | 9/2013 | Grozinger et al. | G01F 15/06 361/54 |

FOREIGN PATENT DOCUMENTS

| | | | |
|---|---|---|---|
| DE | 202005010927 | U1 | 11/2006 |
| DE | 102006016137 | A1 | 10/2007 |
| EP | 0314949 | A1 | 5/1989 |
| EP | 1202424 | A2 | 5/2002 |
| EP | 1638173 | A2 | 3/2006 |

OTHER PUBLICATIONS

European Office Action in corresponding European Application No. 13735308.2, dated Apr. 5, 2016, 6 pages.
Office Action in corresponding German Application No. 10 2012 107 091.1, dated Mar. 27, 2013, 19 pages.

* cited by examiner

ELECTRICAL DEVICE HAVING AN EXPLOSION-PROOF PLUG-IN CONNECTION

CROSS REFERENCE TO RELATED APPLICATIONS

This patent application is the national phase of PCT/EP2013/064728 filed Jul. 11, 2013, which claims the benefit of German Patent Application No. DE 102012107091.1 filed Aug. 2, 2012.

TECHNICAL FIELD

The invention relates to an electrical device having a plug connector for the electrical connection of several components of said electrical device.

BACKGROUND

It has been known to provide plug connectors in explosion-proof operating means, which plug connectors can be used in potentially explosive areas. In conjunction with this, publication EP 1 638 173 A2 suggests plug connectors comprising several contact pins. One of the contact pins is disposed to contact a monitoring conductor. This contact pin is slightly shorter than the other contact pins so that it is the last to act as a contact when the plug-in connection is established and the first to disconnected when the plug-in connection is severed. A voltage is applied to the monitoring conductor, said voltage being below the minimum ignition voltage. Consequently, when the contact point is opened and closed, it is not possible for ignition sparks to form. By means of the monitoring conductor, the power supply to and from the other, longer, contact pins is switched on and switched off. As a result of this it can be ensured that the other, longer, contact pins are always in contact with the respectively allocated sockets in currentless and voltageless state. The combination of a monitoring conductor complying with the type of explosion protection Ex i with other contacts that are closed or opened only in currentless state requires additional switches in the connected components.

Furthermore, publication DE 20 2005 010 927 U1 discloses an explosion-proof plug connector of the ignition protection type pressure-proof encapsulation (Ex d). It is designed in such a manner that the pressure-proof encapsulation is maintained until all contacts are disconnected.

Explosion protection by pressure-proof encapsulation of all contacts results in considerable design and structural expense.

SUMMARY

It is the object of the invention to provide an explosion-proof device that requires only minimal expense and can be used in many applications.

The electrical device in accordance with the invention comprises a plug connector for the electrical connection of two components of the electrical device. The plug connector is disposed for the connection of two sections of an electrical circuit, wherein the first section is arranged in one component of the electrical device and the other section is arranged in the other component of the electrical device. Together, the two sections form an electrical circuit. The plug connector comprises a contact array and a mating-contact array. The contact array comprises at least two contact groups—one for the supply conductor and one away from the return conductor. Each contact group comprises at least one or also several contacts. Likewise, the mating-contact array comprises at least two mating-contact groups. Each mating-contact group comprises at least one, optionally also several, mating contacts. The contacts and the mating contacts can be selectively configured as a plug-in pin or the like, as well as socket contacts or other mating contacts. The contacts and mating contacts form contact/mating-contact pairs. The invention provides that the contact/mating-contact pairs of the supply conductor and the contact/mating-contact pars of the return conductor display different kinds of ignition protection. This being the case, even though the contact/mating-contact pairs of the supply conductor and the return conductor preferably conduct the same load current. However, the contact/mating-contact groups have different initial-contact positions. The contact/mating-contact group that records a later contacting when the plug connector is mated and disconnects earlier when the plug connector is unplugged, exhibits a first type of protection that is different from that of the other contact/mating-contact group. In doing so, the later-engaging and earlier-interrupting contact/mating-contact group (exhibiting the first type of protection) acts as an explosion-proof circuit breaker for the remaining other contact/mating-contact group exhibiting a different (second) type of protection.

Preferably, the second type of protection is of the ignition protection type Ex e. Preferably, the first ignition protection type is the ignition protection type Ex d or Ex i. Referring to the ignition protection type Ex d it is preferred to only configure one or a few contacts in this protection type. Referring to the ignition protection type Ex i, it is preferred for the contact group to comprise several contact/mating-contact pairs. They may be arranged in parallel-connected branches of the electrical circuit. They, too, are preferably associated with respectively individual current-limiting circuits. The design expense of such a plug connector is minimal. The explosion protection is accomplished by electrical means. The current-limiting circuits may be associated with the plug connector arrangement. An interference with the electronics of the electrical circuit to be connected is not required.

Furthermore, none of the intended embodiments requires an additional monitoring conductor.

The contact/mating-contact pairs, in particular in the case of protection type Ex 9, may be associated with voltage-limiting circuits, in addition to the current-limiting circuits. They prevent the spark formation on the contacts that are configured, for example, in type Ex i. This embodiment is particularly suitable for circuits that comprise one or more inductive components in the electrical circuit.

Additional details of advantageous embodiments of the invention are the subject matter of the claims, the description or the drawings. They show in

DETAILED DESCRIPTION

Figure 1:
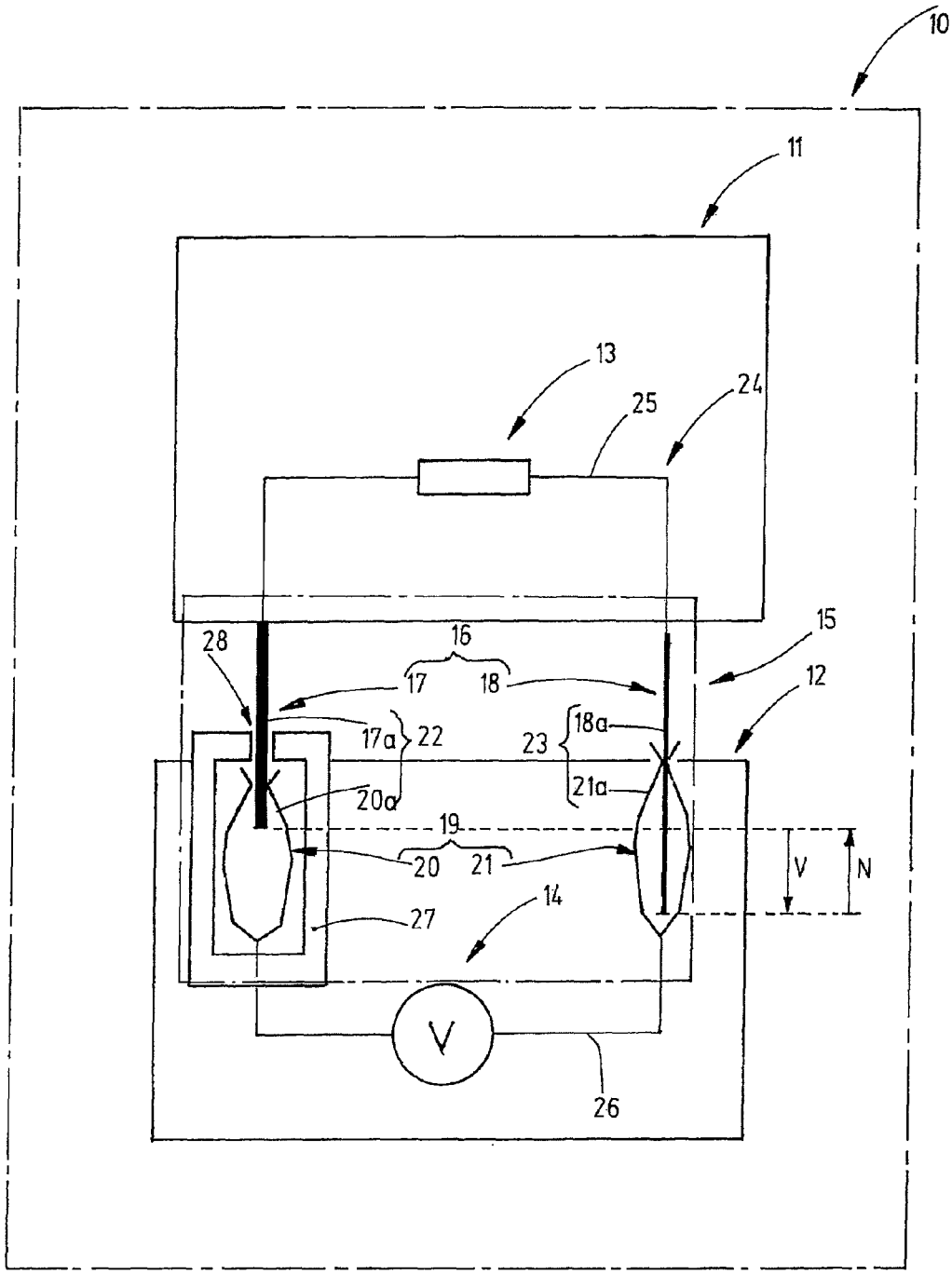
FIG. 1 an extremely schematized representation of a device in accordance with the invention.

FIG. 1 is a schematic illustration of an electrical device 10 that can be operated in a potentially explosive environment. The electrical device 10 comprises at least two components 11, 12 that interact electrically. For example, the component 11 may comprise one or several electrical consumers such as, e.g., light sources, motors, sound generators or other electrical elements or apparatus such as, e.g., computers or the like. Each and every of such consumers are symbolized by a resistor 13 in FIG. 1. Its impedance may be strictly ohmic, strictly reactive, or complex. In addition, the first component 11 may comprise current sources or voltages sources that are not specifically illustrated.

The second component 12 comprises at least one voltage source 14 that feeds the electrical consumer 13. The voltage source 14 may be of any suitable design. For example, it may be configured as a rechargeable battery, a power supply unit, a primary battery, a super capacitor or as any other storage. The second component 12 may comprise several such voltage sources 14 connected in series or connected in parallel. In addition, the second component 12 may comprise electrical consumers.

In order to feed the consumer 13 by means of the voltage source 14, the two components 11, 12 are electrically connected to each other. This is accomplished with a plug-in connection device 15 that is symbolically indicated by a chain line (long/short dashes) quadrangle.

The plug-in connection device 15 comprises a contact array 16 that comprises at least two contact groups 17, 18. The contact group 17 comprises at least one contact 17*a* or also several such contacts. The contact 17*a* (and, optionally, additional contacts belonging to the same contact group 17) may also be configured as plug contacts or, alternatively, as socket contacts.

The second contact group 18 comprises at least one contact 18*a* and, optionally, also several contacts. The contact 18*a* and, optionally, also others may be configured as plug contacts or also as socket contacts.

Furthermore, the plug-in connection device 15 comprises a mating-contact arrangement 19 that comprises a first mating-contact group 20 and a second mating-contact group 21. The first mating-contact group 20 comprises a mating contact 20*a* as well as, optionally, additional mating contacts. The second mating-contact group 21 comprises at least one mating contact 21*a* as well as, optionally, additional mating contacts. The mating contacts 20*a*, 21*a* of the two mating-contact groups as well as, optionally additional mating contacts belonging to the groups may also be configured as plugs or sockets.

The contact 17*a* and the mating contact 20*a*, together, form a contact/mating-contact pair 22. The contact 18*a* and the mating contact 21*a*, together, form a contact/mating-contact pair 23.

The contact/mating-contact pairs 22, 23 form the supply conductor and the return conductor that electrically connect a first section 25 in an electrical circuit 24 to a second section 26. The first section 25 is arranged in the first component 11. The section 25 comprises the electrical consumer 13. The second section 26 is arranged in the second component 12 and contains the source 14.

As a whole, the plug connector 15 complies with a type of high ignition protection such as, e.g., Ex d or Ex i. To accomplish this, the two contact/mating-contact pairs 22, 23 comply with different types of ignition protection. In doing so, the contact-mating-contact pair (here pair 22) that receives the last electrical contact when the plug connector 15 is connected and, at the same time, the one that interrupts the electrical power path when the connection is severed, is configured in the first type of ignition protection (here, e.g., Ex d). The ignition protection type Ex d is achieved, in accordance with the example, by encasing the mating-contact group 20 and the mating contact 20*a*, respectively, said latter contact group defining, with the contact group 17 and the contact 17*a*, respectively, a gap 28 that is long enough and narrow enough that, in the case of an explosion inside the casing 27, neither flames nor glowing particles can escape.

In contrast, the other contact/mating-contact pair 23 is configured in the second type of ignition protection e.g., Ex e. It is viewed as an inactive electrical contact that will close or open only when it is currentless. The currentless state is achieved during the closing operation by the lead V and during the opening operation by the trail N, with which the contact 18*a* works—compared with the contact 17*a*. In the simplest case, the lead V and the trail N can be achieved by a length difference of the contacts 17*a*, 18*a*. Alternatively or additionally, a position difference or length difference of the mating contacts 20*a*, 21*a* may be provided.

The leading closing of the contact/mating-contact pair 23 and the trailing opening thereof may also be achieved with other means. For example, the plug connector 15 may comprise other means in order to allow the establishment of the electrical contact between the contact 17*a* and the mating contact 20*a* only whenever the contact 18*a* and the mating contact 21*a* are safely touching. These means may also be provided to safely release the contact 17*a* and the mating contact 20*a*—before the contact 18*a* and the mating contact 21*a* separate. For example, isolating elements may be provided for this, said elements moving the contact 17*a* and the contact 20*a* in a direction other than the plug-in direction (e.g., transversely thereto) and thus close or open whenever the plug-in connection is to be established or interrupted.

The device 10 operates as follows:

If the components 11, 12 are provided, the plug-in connection device 15 is initially in disconnected state. When the contact array 16 is connected to the mating contact array 19 in that they are moved toward each other, the contact/mating-contact pair 23 is initially closed. This is done in the currentless state because the electrical circuit 24 is not yet closed. The electrical circuit 24 closes as soon as the contact 17*a* is inserted into the casing 27 and touches the mating contact 20*a* inside said casing. In doing so, sparks may potentially form which will ignite an ignitable mixture in the casing. The casing 27 is dimensioned in such a manner that it withstands the resultant explosion. Occurring excess pressure can be reduced through the gap 28, in which case the length and the minimal width of the gap 28 prevent the escape of flames or glowing particles. The conditions are the same when an ignition spark occurs inside the casing 27 when the plug-in device 15 is disconnected.

Inasmuch as only one of the two contact/mating-contact arrays 22, 23 will close and open in current-conducting state, i.e., the pair 22, the other pair 23 does not require an explosion-proof casing. Consequently, consistent with the present concept, a smaller, more simply constructed, less space-consuming plug-in connection device 15 can be designed, said plug-in device being usable in a potentially explosive environment.

Figure 2:
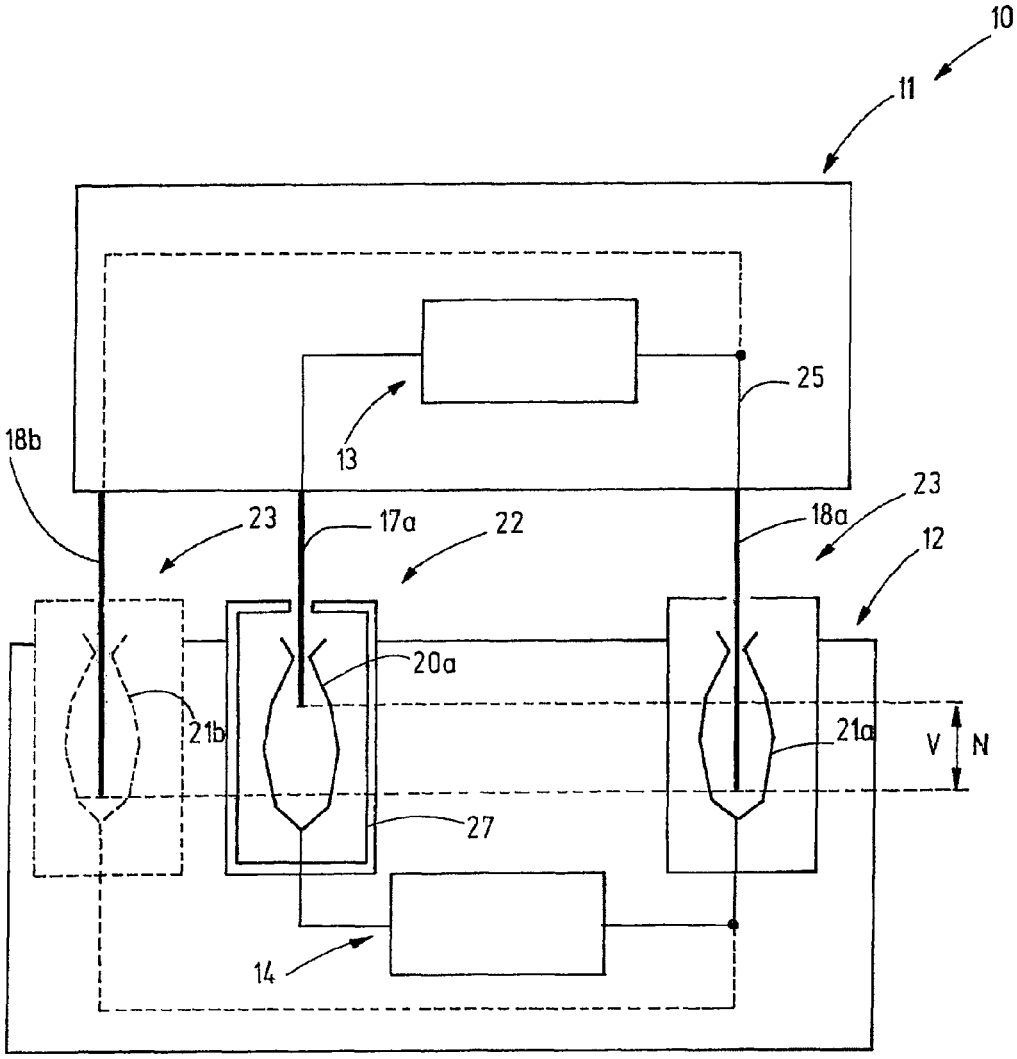
FIGS. 2 through 6 a schematized block circuit diagram of additional alternative exemplary embodiments of the device in accordance with the invention.

FIG. 2 shows a modified embodiment of the device 10. The description hereinabove using the already introduced reference signs applies accordingly. The consumer 13 and the voltage source 14 are symbolically indicated by blocks. They may contain several or many electrical or electronic components, including current and voltage sources of ohmic elements in reactive elements or the like.

It is obvious that the contact/mating-contact pair 23 may comprise several contacts 18*a*, 18*b* as well as mating contacts 21*a*, 21*b*. These are electrically connected in parallel.

Preferably, they are arranged on both sides of the contact/mating-contact pair 22. As a result of this, a protection against a skewed position is achieved during pulling and plugging operations. Due to an integral or externally provided mechanical guide of the part to be guided, a skewed position is prevented. If the contacts 18*a*, 18*b* and the mating contacts 21*a*, 21*b* are arranged on opposite sides of the contact/mating-contact pair 22, a parallel guide may be also be omitted because, even if the corresponding plug components are in a skewed position, a safe leading or trailing of the contacts 18*a*, 18*b* is ensured.

Another advantage of using several, e.g., parallel-connected, contacts 18*a*, 18*b* or mating contacts 21*a*, 21*b* in the contact/mating-contact pair 23 that will lead at closing and trail at opening is the avoidance of latently dangerous current flow interruptions, for example, due to dust or debris deposits on the contact surfaces, when the contacts 18*a*, 18*b* are sliding in or on the mating contacts 21*a*, 21*b*.

In the embodiments as in FIGS. 1 and 2 described hereinabove, the contact/mating-contact pair 22 is configured as ignition protection type Ex d. The other contact/mating-contact pair 23 is configured as ignition protection type Ex e so as to be leading when plugged in and trailing when pulled out. As a result of this, the electrical current is safely interrupted when opened via the Ex d contact, before the Ex e connection is interrupted. When closing, the Ex e contact is already closed until the trailing Ex d contact closes the electrical circuit. As mentioned, there may also be more contacts and mating contacts that can be connected in parallel. This applies to the Ex e contacts as well as to the Ex d contacts.

Figure 3:
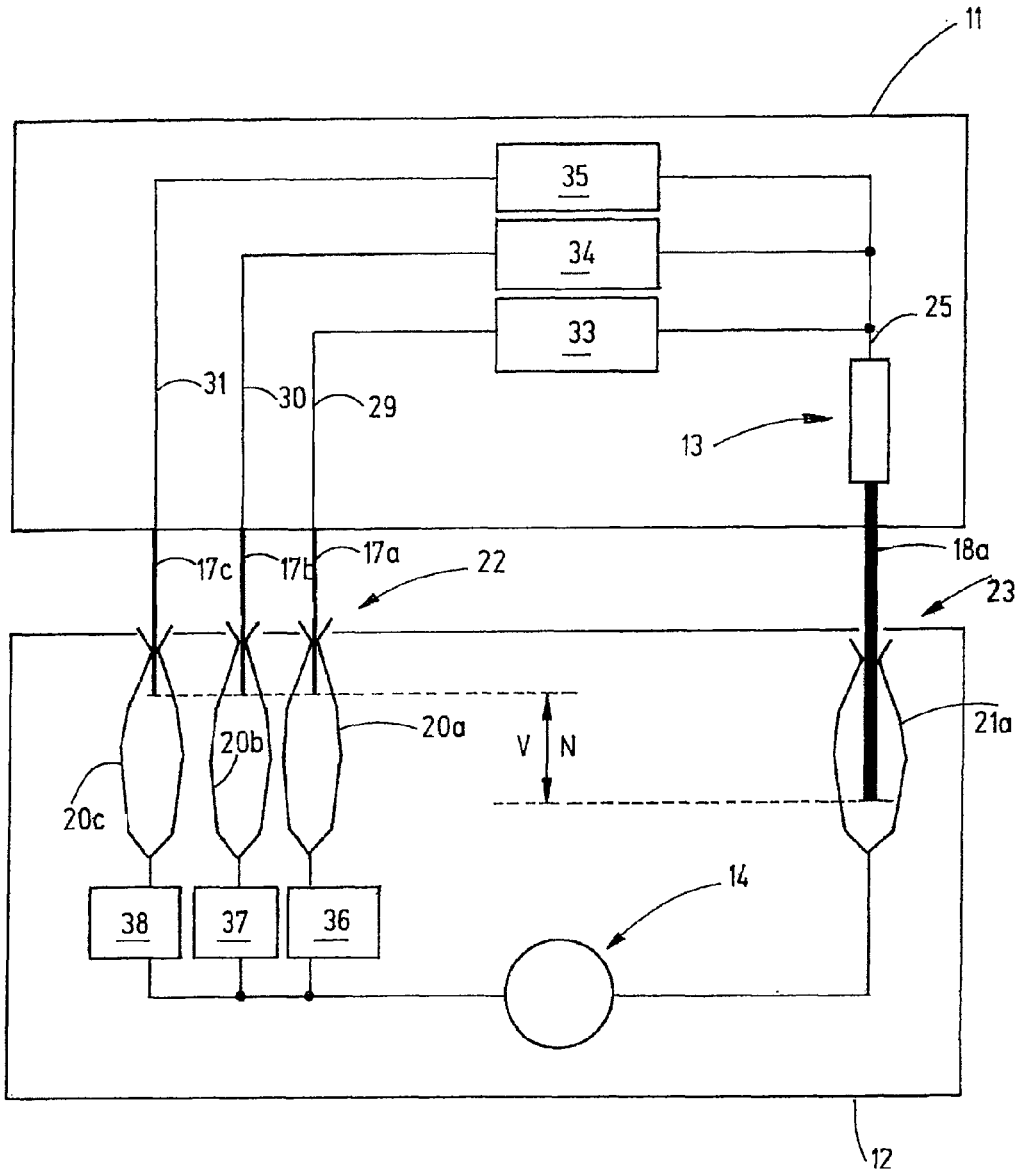

Another modification of the combination of various protective types can be inferred from the embodiment according to FIG. 3. Here, several contact/mating-contact pairs 22 having contacts 17*a*, 17*b* and mating contacts 20*a*, 20*b*, 20*c*, without individual or shared casings, are provided in a design so that they will be closing when trailing and opening when leading. The contacts and mating contacts comply with the ignition protection type Ex i. Again, the contact/mating-contact pair 23 is configured as the ignition protection type Ex e. The electrical circuit 24, to the extent that it conducts via the contacts 17*a* through *c* and the mating contacts 20*a* through *c*, is divided into branches 29, 30, 31 that are parallel to each other. These branches contain current limiting devices 33 through 38—at least in one of the components 11, 12 and preferably in both. These may be ohmic resistors or also complex resistors or electronic circuits that switch off when a limiting current is reached, or they limit this current. Such current-limiting circuits can be composed of transistors or other electronic components or be integrated circuits that monitor and, if necessary, reduce the flowing current.

As is obvious, the principle of this is that the conductor (supply conductor or return conductor) is guided in a multipolar manner over several Ex i contacts. To accomplish this, the electrical circuit 24 is divided into several intrinsically safe electrical currents. The Ex i contacts take over the activation of the electrical current before the interruption. Independent of the protection type Ex i for the contact/mating-contact array 22, the components 11, 12 may also be completely or partially encapsulated.

Figure 4:
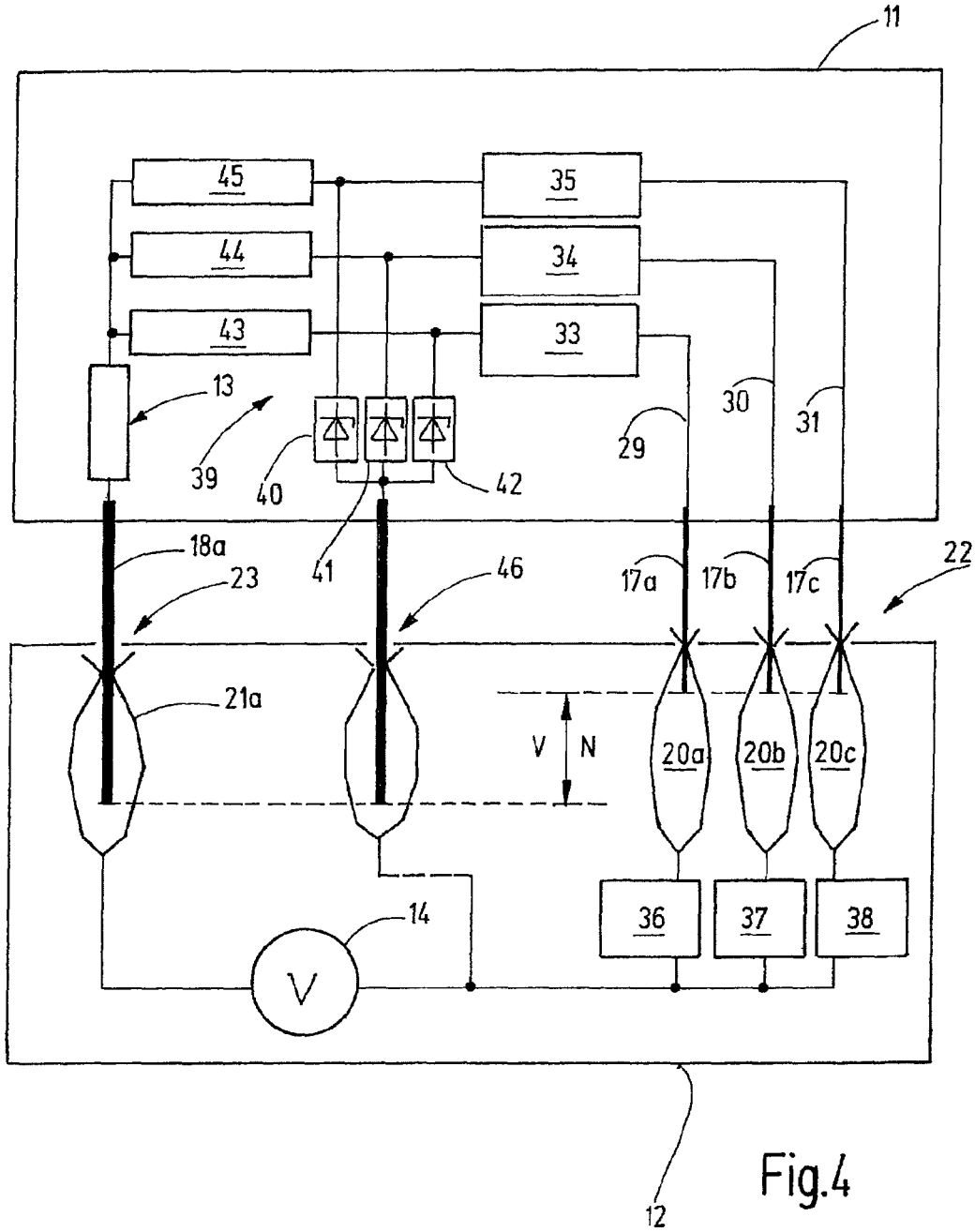

As is obvious from FIG. 4, it is possible, in addition to the configuration described in conjunction with FIG. 3, to provide a voltage-limiting device 39 that limits the voltages occurring at the Ex i contacts of the contact/mating-contact pairs 22. For example, this may be done by voltage-limiting diodes, e.g., Zener diodes 40, 41, 42 that are connected to the branches 29, 30, 31 and set to a common ground potential. Alternatively, the connection point of the Zener diodes 40 through 42 may also be connected via a contact/mating-contact pair 46 to a suitable point of the electrical circuit 24 in the respectively other component—in this case the component 12. Upstream of the Zener diodes 40 through 42, there may be resistors 43, 44,45 in order to again limit the occurring current. Other than that, the description hereinabove applies analogously.

Figure 5:
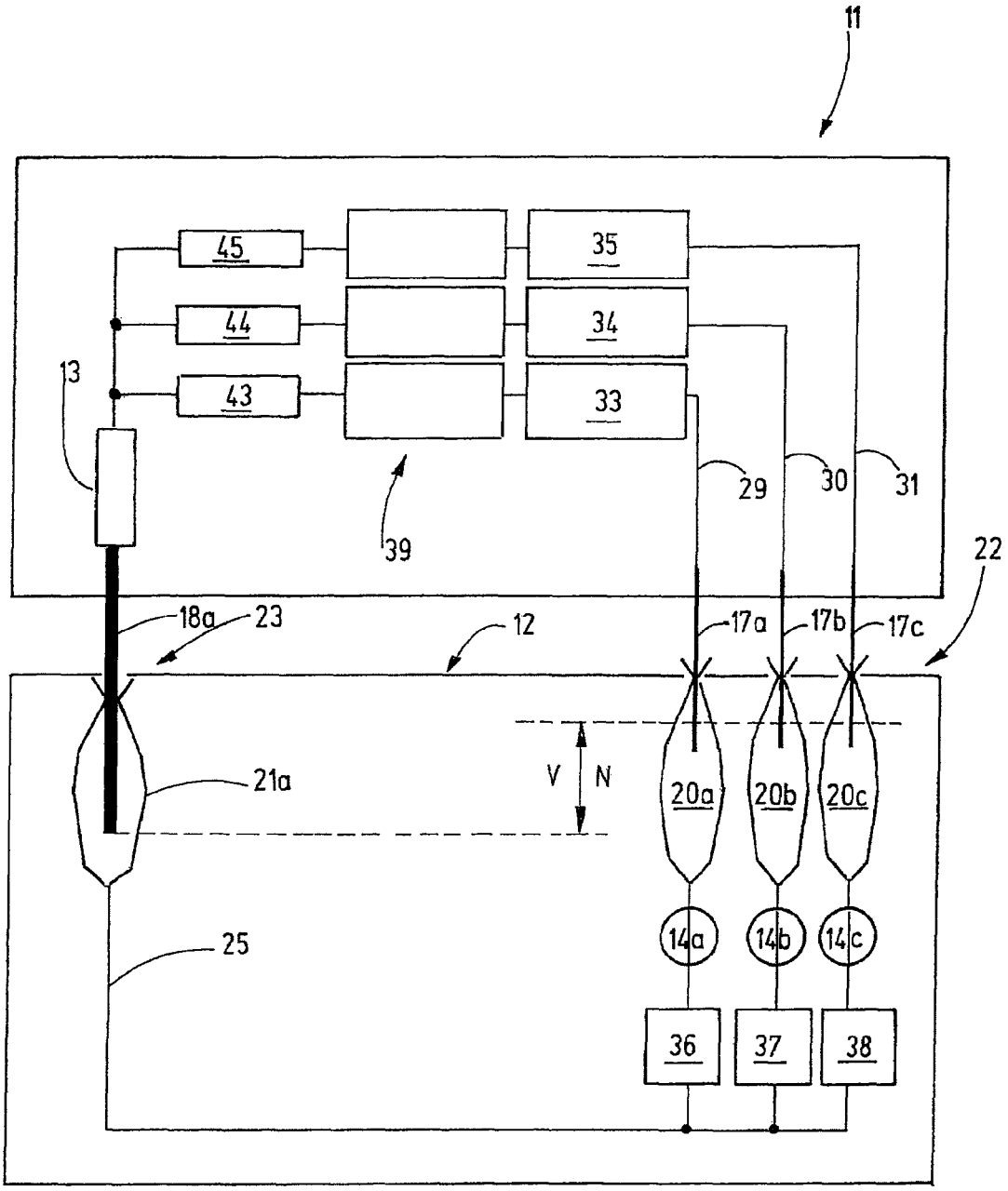

As shown by FIG. 5, the embodiment of FIG. 4 can be modified such that the voltage source 14 may be divided into individual voltage sources 14*a* through 14*c*. Again, the electrical current 24 is divided in individual Ex i electrical circuits in the different branches 29, 30, 31. The number of these individual branches results from the flowing current that is desired by the consumer 13 and the current load applied to each contact 17*a* through *c*. Again, the contact/mating-contact pair 23 is preferably an Ex e contact. Other than that, the description hereinabove applies analogously.

Figure 6:
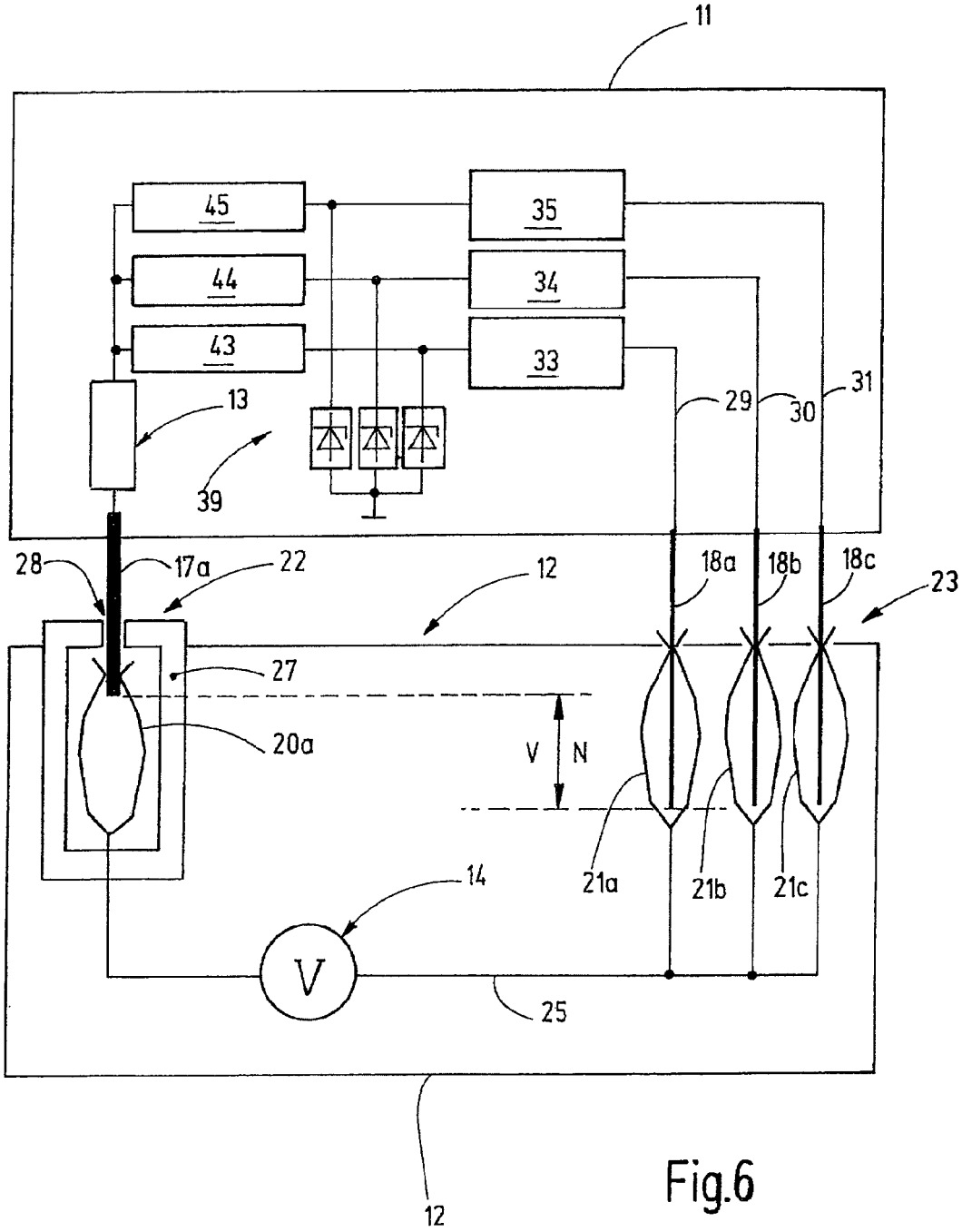

FIG. 6 illustrates a modified embodiment wherein several contact/mating-contact pairs 23 configured as an ignition protection type Ex i interacts with a contact/mating-contact pair 23 configured as an ignition protection type Ex d. Considering the embodiment of the contacts 17*a*, 20*a*, as well as contacts 18 (*a, b, c*) and the mating contact 21 (*a, b, c*), reference is made to the description hereinabove. In this case, the switching contact is the contact/mating-contact pair 22. The latter is provided with the casing 27 that provides the explosion protection. The contact/mating-contact pairs 23 arranged in the branches 29, 39, 31 are the contact pairs that lead during the plugging operation and that trail during the pulling operation. The current-limiting devices 33 through 35 are connected upstream and/or downstream from them. Furthermore, a voltage-limiting device 39 may be provided.

Again, the electrical circuit 24 is divided into several intrinsically safe electrical currents or branches 29 through 31. Consequently, one of the conductors (supply conductor or return conductor) is guided in a multipolar manner over the Ex i contacts. The other conductor is guided over one or more contact/mating-contact pairs configured so as to satisfy Ex d criteria. A current and/or voltage limitation may be provided in the component 11 and, additionally or alternatively, in the component 12. Considering internal electrical circuits, the voltage-limiting device 39 may be supported to ground. In external electrical circuits a connection modeled on FIG. 4 may be provided. Both components 11, 12 may be fully or partially encapsulated (e.g., configured as ignition protection type Ex d or also Ex m).

All embodiments comprising several contacts 17*a-c* or 18*a-c*, in particular those as in FIGS. 5 and 6, may be used in the design of a bus system. For example, the respective contacts 17*a*-17*c* (FIG. 5) or 18*a*-18*c* (FIG. 6) may be configured as bus lines. The voltage source 14 may be accommodated in component 11. The module 12 or several modules 12 parallel thereto may then be plugged onto the bus lines. However, it is also possible, to use the contacts 20*a*-20*c* and 21*a*-21*c*, respectively, as bus lines. Again, one or more components 11 may be plugged onto those bus lines belonging to the module 12. In both mentioned cases, the bus lines may be flexible or rigid. insulated or bare bus lines.

The aforementioned embodiments are described in conjunction with contact/mating-contact pairs 22, 23 that comprise adjacent, parallel-oriented contacts 17, 18 and mating contacts 20, 21. However, it is also possible to configure at least one of the contact/mating-contact pairs (e.g., 23) in such a manner that it concentrically surrounds the other contact/mating-contact pair 22. In such a, for example coaxial, arrangement the contact/mating-contact pair 23 can form the Ex d casing for the contact/mating-contact pair 22 (and, optionally, additional ones, e.g., 46).

An electrical device comprises a plug-in device 15 that is disposed for opening and closing an electrical circuit 24. The plug-in connection device 15 contains at least two contact/mating-contact pairs 22, 23, which are of different ignition protection types. At least one of the two contact/mating-contact pairs is designed to interrupt the current running through said contact/mating-contact pair without triggering an explosion (ignition protection type Ex d or Ex i.) The other contact/mating-contact pair 23 opens and closes in the currentless state. Therefore, the other contact/mating-contact pair can be of a second ignition protection type, such as Ex e.

LIST OF REFERENCE SIGNS

10 Device
11 First component of the device 10
12 Second component of the device 10
13 Electrical consumer
14 Voltage source
14*a-c* Single voltage source
15 Plug-in connection device
16 Contact array
17 First contact group
18 Second contact group
19 Mating-contact array
20 First mating-contact group
21 Second mating-contact group
22 Contact/mating-contact pair
23 Contact/mating-contact pair
24 Electrical circuit
25 First section of the electrical circuit 24
26 Second section of the electrical circuit 24
27 Casing
28 Gap
V Lead
N Trail
29-31 Branches
33-38 Current-limiting devices
39 Voltage-limiting device
40-42 Zener diodes
43-45 Resistors
46 Contact/mating-contact pair

The invention claimed is:

1. Explosion-proof electrical device (10) with a plug connector (15) for the electrical connection of first and second components (11, 12) of the electrical device (10), comprising:

the plug connector 15 including a contact array 16 and a mating-contact array 19, the first component (11) having a first section (25) of an electric circuit (24) that is connected to the contact array (16), the second component (12) having a second section (26) of the electric circuit (24) that is connected to the mating-contact array (19), wherein the first and second sections (25, 26) are electrically connected in series, the contact array (16) comprising at least two contact groups (17, 18) that are electrically connected to the first section (25), the mating-contact array (19) comprising at least two mating-contact groups (20, 21) that are electrically connected to the second section (26), wherein each of the contact groups (17, 18) and the mating-contact groups (20, 21) form contact/mating-contact pairs (22, 23) configured as at least two different ignition protection types, wherein a first of the contact/mating-contact pairs (22) is configured in a first type of ignition protection Ex d and to receive the last electrical contact of the contact/mating-contact pairs (22, 23) when the plug connector (15) is connected and to interrupt the electrical power path when the connection is severed, wherein a second of the contact/mating-contact pairs (23) is configured in a second type of ignition protection that is different from the first type.

2. Device as in claim 1, wherein a same current flows through the contact/mating-contact pairs (22, 23).

3. Device as in claim 1, wherein each contact group (17, 18) comprises one or more contacts (17*a*, 17*b*, . . . ; 18*a*, 18*b*, . . . ), and/or that each mating-contact group (20, 21) comprises one or more mating contacts (20*a*, 20*b*, . . . ; 21*a*, 21*b*, . . . ).

4. Device as in claim 1, wherein the contact/mating-contact groups (22, 23) exhibit different initial touch positions.

5. Device as in claim 1, wherein the contact/mating-contact group (22) configured as the first protection type is designed for a later contact engagement and an earlier contact interruption, and that the contact/mating-contact group (23) configured as the second protection type is designed for an earlier contact engagement and a later contact interruption.

6. Device as in claim 1, wherein the second type of ignition protection is the Ex e type of protection.

7. Device as in claim 1, wherein only a single contact/mating-contact pair (22) is configured as the first protection type.

8. Device as in claim 1, wherein several of the contact/mating-contact pairs (22, 23) are arranged in parallel-connected branches (29, 30, 31) of the electrical circuit (24).

9. Device as in claim 8, wherein each of the branches (29, 30, 31) comprises at least one current-limiting circuit (33-38).

10. Device as in claim 9, wherein in one, more or all branches (29, 30, 31), the current-limiting circuit (33-38) is arranged in only one of the sections (26, 27).

11. Device as in claim 9, wherein in one, more or all branches (29, 31), a current-limiting circuit (33-38) is arranged in both sections.

12. Device as in claim 1, wherein a voltage-limiting circuit (33-38) is arranged in one of the sections (25, 26).

13. Device as in claim 12, wherein the voltage-limiting circuit (39) is connected to a contact/mating-contact pair (46) that comprises protective type Ex d and the earlier contact engagement position, as well as the later contact interruption position.

14. The device as in claim 3, wherein the ignition protection type Ex d is achieved by encasing the mating-contact group (20) and the mating contact (20*a*), wherein the mating-contact group (20) along with the contact group (17) and the contact (17*a*) define a flame-proof gap (28).

* * * * *